United States Patent [19]

Bremmer, Jr. et al.

[11] 3,951,061

[45] Apr. 20, 1976

[54] LABEL PRINTING APPARATUS

[75] Inventors: David F. Bremmer, Jr., Bellbrook; Ray D. Deeter; Daniel L. Goetz, both of Kettering; William L. Behnken, Dayton; Julian F. Madden, Springboro, all of Ohio

[73] Assignee: Custom Printers, Inc., Dayton, Ohio

[22] Filed: May 17, 1974

[21] Appl. No.: 470,749

[52] U.S. Cl. ..... 101/93.12; 101/93.21; 101/93.29; 101/93.48; 101/111; 101/227; 101/235; 101/288; 188/334; 197/164

[51] Int. Cl.[2] ..... B41J 1/38

[58] Field of Search ..... 197/160, 164; 188/334, 188/325; 101/76, 93.03, 93.07, 93.12, 93.21, 93.22, 93.28, 93.29, 93.35, 93.48, 109, 111, 226–228, 235, 287, 288, 292, 234, 93.33

[56] References Cited

UNITED STATES PATENTS

| | | | |
|---|---|---|---|
| 1,864,694 | 6/1932 | Rosalelli | 188/334 |
| 1,941,380 | 12/1933 | Antelne et al. | 188/334 |
| 2,909,991 | 10/1959 | Farkas | 101/111 |
| 3,037,447 | 6/1962 | Gonzalez et al. | 101/235 |
| 3,128,698 | 4/1964 | Hennequin | 101/235 |
| 3,138,098 | 6/1964 | Worth | 101/235 |
| 3,183,830 | 5/1965 | Fisher | 101/93.03 |
| 3,198,114 | 8/1965 | Jones et al. | 101/228 |
| 3,279,576 | 10/1966 | Howard | 197/49 |
| 3,394,853 | 7/1968 | Foley et al. | 101/93.29 |
| 3,406,628 | 10/1968 | Le Gault | 101/288 |
| 3,417,689 | 12/1968 | Brethen | 101/292 |
| 3,452,627 | 7/1969 | Goodman et al. | 101/228 |
| 3,461,984 | 8/1969 | Phillips et al. | 101/228 |
| 3,493,091 | 2/1970 | Kapp | 197/55 |
| 3,585,931 | 6/1971 | West et al. | 101/228 |
| 3,596,593 | 8/1971 | Wade | 101/93.28 |
| 3,605,611 | 9/1971 | Konkel et al. | 101/93.33 |
| 3,670,981 | 6/1972 | Cavella | 197/164 |
| 3,731,622 | 5/1973 | Baranoff | 101/93.22 |
| 3,734,012 | 5/1973 | Huggins | 101/93.29 |
| 3,735,700 | 5/1973 | Roser | 101/228 |
| 3,768,402 | 10/1973 | Levesque et al. | 101/109 |
| 3,865,030 | 2/1975 | Chida et al. | 101/93.22 |

OTHER PUBLICATIONS

Ribbon Feed and Reverse Mechanism for cases, K Hartmann IBM Tech. Discl. Bull. Vol. 12 No. 11, p. 1745 (4/1970).

*Primary Examiner*—Edgar S. Burr
*Assistant Examiner*—William Pieprz
*Attorney, Agent, or Firm*—Jacox & Meokstroth

[57] ABSTRACT

A strip of label material is fed from a supply roll to a preprint unit which incorporates a set of strip feed rolls driven by an electric motor-reducer drive unit. The drive unit is adapted to be stopped by a rotary solenoid actuated brake controlled by a photocell which senses the advancement of the strip. A print drum is rotatably supported above the generally horizontal path of the strip and has peripherally spaced axially extending rows of printing characters. A set of hammer members are positioned under the print drum and are selectively actuated by a corresponding set of solenoids. The print drum is indexed at a high speed by an electric stepping motor which automatically returns to a start position, and the printing characters are inked by a ribbon which is advanced by another electric motor-reducer drive unit pivotally supported to provide for automatically reversing the feed direction of the ribbon. A post-print unit includes a solenoid actuated rotary cutter which is positioned in the path of the strip for shearing each label from the strip, and each label is printed by a rotary print cylinder which carries an axially removable peripheral print key and encloses a plurality of individually adjustable endless flexible printing bands. The print cylinder is driven through a friction clutch by another electric motor-reducer drive unit, and a releasable latch positively stops the print cylinder after each revolution.

13 Claims, 15 Drawing Figures

LABEL PRINTING APPARATUS

BACKGROUND OF THE INVENTION

In an automatic computing scale system such as, for example, disclosed in U.S. Pat. No. 2,948,466, a label printing unit is used for successively printing a continuous series of labels with different information corresponding to the weight and computed value of food products or other commodities or articles being weighed. The labels are also frequently printed with certain fixed or common information or data such as the name and grade of the particular food product or commodity. U.S. Pat. No. 3,477,992 discloses a typical label printing apparatus or machine wherein an axially arranged set of rotary type wheels are positioned on one side of a label strip and are preset according to the weight and computed value determined by the computer scale system. A single hammer member is positioned on the other side of the label strip, and is actuated in response to movement of a lever which engages a motor driven cam. As shown in U.S. Pat. Nos. 3,447,992 and No. 3,526,189, the labels may be supplied in the form of pressure sensitive labels which are carried by a paper backing strip, or the labels may be cut from a continuous paper label strip which has a coating of heat activated adhesive on the back side.

In such a label printing apparatus or machine, it is highly desirable for each of the label handling and printing operations to be responsive to an independent corresponding electrical control so that operations may be precisely synchronized to obtain a maximum printing speed and so that the machine is completely compatible with the electrical control signals received from the computing scale system. It is also desirable to provide for conveniently and quickly changing the common information or data which is printed on a series of labels and also to avoid the requirement for purging the printing system through one or more cycles after the common information or data has been changed. In addition, it is desirable for the label printing machine to be of simplified construction in order to minimize maintenance and to be formed of modular units so that each unit may be quickly interchanged or replaced by another unit during a service call in the field and thereby avoid interrupting the use of machine for an extended period of time.

SUMMARY OF THE INVENTION

The label printing apparatus of the present invention provides all of the desirable features mentioned above and, in addition, is dependable and accurate in operation. In general, the illustrated embodiment of label printing apparatus constructed in accordance with the invention, includes a set of pinch rolls for receiving a strip of label material and which are driven by an electric motor-reducer unit coupled to a rotary solenoid actuated brake. The strip is fed along a generally horizontal path and under a print drum which has peripherally spaced and axially extending rows of printing characters. The print drum is enclosed by part-cylindrical shield which guides an ink ribbon extending from spools driven by another electric motor-reducer unit through an automatic reversing mechanism. A set of hammer members are supported for vertical movement below the print drum in alignment with the rows of characters on the print drum, and the hammer members are selectively actuated by a set of interfitting levers connected to corresponding solenoids. The print drum is indexed by an electrically operated stepping motor which is controlled to return to a fixed home position after each printing cycle.

After each label is printed with its corresponding different information or data by the cooperation of the print drum and the selectively actuated hammer members, the label is fed into a post-printing unit which includes a rotary cut-off member actuated by a rotary solenoid. The post-printing unit also includes a print cylinder which carries an axially removable data print key and encloses a plurality of endless flexible printing bands. The bands are separately adjustable by corresponding concentric shafts projecting axially from the print cylinder. Another electric motor-reducer unit drives the print cylinder through a slip clutch, and the print cylinder is automatically latched after each revolution. The print cylinder has peripherally extending rim surfaces so that the print cylinder feeds each preprinted label while it receives the selected common information or data.

Other features and advantages of the invention will be apparent from the following description, the accompanying drawings and the appended claims.

DESCRIPTION OF THE PREFERRED EMBODIMENTS

As mentioned above, the printing apparatus of the invention is ideally suited for successively printing a series of labels L (FIG. 2) from a paper strip S supplied from a roll R. Each label L is printed with different information or data such as, for example, the net weight and computed value (FIG. 2) of a product which has been weighed by the computing scale system connected to control the operations of the printing apparatus of the invention. As mentioned above, the series of labels may also receive fixed or common information or data such as, for example, a description of the type of product being weighed and the date the product was weighed.

Figure 1:
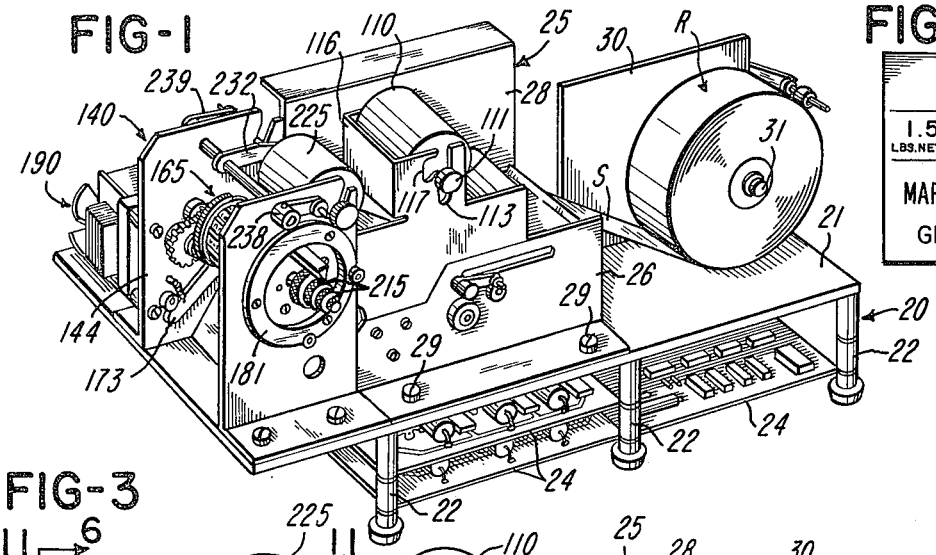
FIG. 1 is a perspective view of a label printing apparatus constructed in accordance with the invention.

Referring to FIG. 1, the printing apparatus of the invention includes a fabricated base frame 20 formed by a rectangular horizontal base plate 21 supported by a set of rod-like vertical posts or legs 22. Each of the legs 22 includes a set of vertically spaced circumferential grooves for receiving a set of flat circuit boards 24 on which are mounted the electronic components and control circuits required for operating the label printing machine. Each of the circuit boards 24 carries a plug (not shown) which connects the circuit board to the other circuit boards and the main electrical control box and provides for conveniently removing the circuit board for servicing by simply pulling the circuit board out of the retaining grooves within the support legs 22.

The base frame 20 supports an independent modular preprint unit 25 which includes a vertical front or outer wall 26 and a parallel vertical rear or inner wall 28. The walls 26 and 28 have outwardly formed bottom flanges which are fastened to the horizontal base plate 21 by a set of screws 29 to permit removal of the unit 25. Another vertical wall 20 also has a base flange secured to the base plate 21 and supports a cantilevered spindle 31 which supports the core of the supply roll R of the strip S of paper label material.

The sidewalls 26 and 28 of the preprint unit 25 support a bottom horizontal guide plate 32 (FIG. 8) and an upper guide plate 33 which are positioned in closely spaced parallel relation to define a narrow gap for receiving and guiding the label strip S. Each of the guideplates 32 and 33 has a set of edge tabs which project outwardly into corresponding triangular shaped openings (not shown) within the sidewalls 26 and 28 for retaining the guide plates in closely spaced parallel relation.

A friction drive roll 36 (FIG. 8) is rotatably supported adjacent an opening within the bottom guide plate 32 and has a resilient outer surface which engages the underneath surface of the strip S. A pressure roll 38 is positioned above the roll 36 within a opening in the upper guide plate 33 and is supported by an eccentric shaft 39 which is rotatable for adjusting the pressure exerted by the roll 38 against the drive roll 36 to vary the degree of gripping of the paper strip S. The bottom drive roll 36 is driven by an endless flexible gear belt 41 (FIG. 8) which extends around a gear-like wheel 42 (FIG. 5) mounted on the output shaft of an electric motor-gear reducer unit 45 supported by the rear or inner wall 28.

Figure 5:
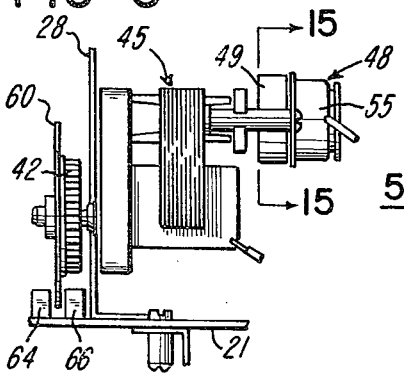
FIG. 5 is a view taken generally on the line 5—5 of FIG. 4.
Figure 4:
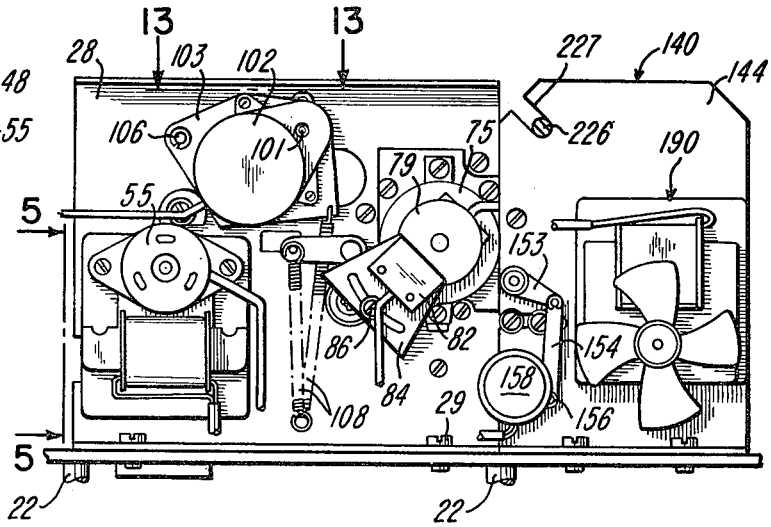
FIG. 4 is a fragmentary elevational view of the opposite side of the printing unit shown in FIG. 1.
Figure 15:
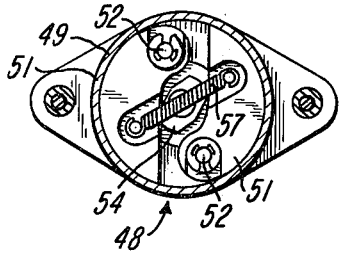
FIG. 15 is an enlarged section of a braking mechanism, as taken generally on line 15—15 of FIG. 5.

An electrically actuated brake mechanism 48 (FIG. 5) is connected to the unit 45 for braking the shaft of the electric motor and includes a cap-shaped brake drum 49 (FIGS. 4 and 15) which is secured for rotation with the motor shaft. A set of brake shoes 51 (FIG. 15) are positioned within the drum 49 and are pivotally supported by corresponding stationary studs 52. A cam member 54 is positioned between the brake shoes 51 and is mounted on the rotary output shaft of a rotary solenoid 55 (FIG. 5). When the solenoid 55 is energized, the cam member 54 rotates and shifts the brake shoes 51 outwardly into friction engagement with the drum 49 to brake the shaft of the electric motor of the motor-reducer unit 45. A tensioned coil spring 57 (FIG. 15) connects the shoes 51 and returns the shoes to a released position when the solenoid 55 is deenergized.

A timing disc 60 (FIGS. 5 and 8) is secured to the drive wheel 42 for rotation with the output shaft of the motor-reducer unit 45 and has a plurality of peripherally spaced slots 62 which are sequentially sensed by a photo cell 64 which receives a light beam through a slot 62 from a light source 66. The photo cell 64 is connected to detect the slots 62 when the drive unit 45 is energized and the paper strip S is being advanced. Each slot 62 is positioned for a predetermined label length. After a slot is detected, drive unit 45 is deenergized and the brake mechanism 48 is energized so that the rotation of the drive wheel 42 and drive roll 36 is immediately stopped. In some installations, the paper strip S may be provided with a series of longitudinally spaced apertures which are ultimately located between the labels printed on the strip. When these apertures are employed, a reflective type light source and photo cell unit 68 (FIG. 8) may be used to sense each aperture within the strip S and control the brake mechanism 48 of the paper feed drive unit 45 and thereby assure precise incremental feeding of the paper strip S.

A print drum 70 (FIG. 8) is mounted on a shaft 72 which forms an extension of the output shaft of an electrically actuated stepping motor 75 (FIGS. 4 and 9) having a mounting flange secured to the rear wall 28 of the preprint unit 25. The print drum 70 has a plurality of circumferentially spaced and axially extending facets or flat surfaces 77, and each surface 77 carries a row of identical characters such as a row of "0," "1," "2," etc. The stepping motor 75 is operated by three phase current and produces high speed indexing of the print drum 70 in the increments of 15° or 24 times per revolution so that each row of characters on the corresponding surface 77 is in position every two steps for a fraction of a second directly above the paper strip S supported by the bottom guide plate 32. A disc 79 (FIGS. 4 and 9) is mounted on the opposite end of the shaft of the stepping motor 75 and has a single radial slot which is sensed by a photocell unit 82. The photocell unit 82 is connected to detect home position and electrically produce a small holding current to the stepping motor 75 and thereby maintain the print drum 70 in a fixed home position after each label printing cycle. The photocell unit 82 is mounted on plate-like bracket 84 (FIG. 4) which is adapted to pivot on the axis of the stepping motor 75. The bracket 84 may be adjustably positioned by releasing a screw 86 extending through an arcuate slot within the bracket 84.

Figure 10:
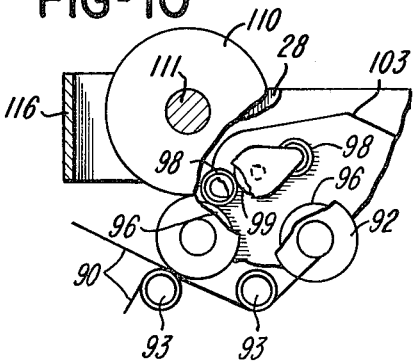
FIG. 10 is a fragmentary section of the preprint unit shown in FIG. 8 and with a portion broken away to illustrate an ink ribbon drive meachanism.

A part cylindrical shield 88 (FIG. 8) extends around the print drum 70 and defines a laterally extending slot along the bottom of the print drum. The shield 88 forms a guide for an inking ribbon 90 which extends from a pair of supply and rewind spools 92 around a set of guide rollers 90 and under the bottom of the print drum 70 adjacent the horizontal path of the label strip S. Each of the inking ribbon spools 92 is mounted on a corresponding shaft 94 which supports a gear drive wheel 96 (FIG. 10). The drive wheels 96 are alternately driven in opposite directions by a pair of planetary gears 98 which engage a sun gear 99 mounted on the output shaft 101 (FIG. 4) of a small motor-gear reducer unit 102.

Figure 13:
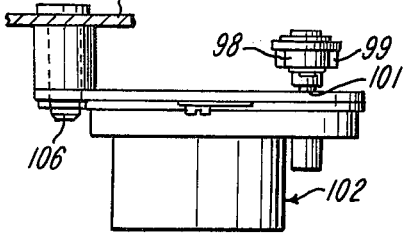
FIG. 13 is an enlarged view of the drive mechanism for the inking ribbon, as taken generally on the line 13—13 of FIG. 4.

The motor-reducer unit 102 is mounted on a plate 103 (FIGS. 4 and 13) which is pivotally supported by a stud 106 secured to the inner wall 128 of the preprint unit 25. A tension spring 108 (FIG. 4) connects the opposite end of the plate 102 to a pin secured to the wall 28 and urges one of the planetary gears 98 into engagement between the sun gear 99 and the adjacent gear 96 on one of the spool shafts 94. When the inking ribbon 90 is fully wound onto one of the spools 92, and the corresponding gear 96 is restrained from rotating, the motor-reducer unit 102 moves upwardly to permit the planetary driving gear 98 to orbit approximately 90° until it engages the gear 96 on the other spool shaft 94 and thereby automatically reverses the feed of the inking ribbon 90.

A porous type inking roll 110 (FIG. 8) is positioned to engage the inking ribbon 90 as it is wound or unwound upon the left spool 92. The inking roll 110 is mounted on a shaft 111 which has opposite end portions or journals projecting into corresponding vertical slots 113 within a U-shaped bracket portion 116 (FIG. 1) formed as part of the front or outer wall 26 of the preprint unit 25. A set of notches 117 (FIGS. 1 and 8) extend laterally from the vertical slots 113 and are adapted to receive and retain the journals of the shaft 111 when it is desired to elevate the inking roll 110 to a position where it does not engage the inking ribbon 90.

It is also within the scope of the invention to use a releasable "one time" carbon strip in place of a reuseable inking ribbon 90 and the inking roll 110. In such a modification, the spools 92 would be substantially larger in diameter in order to hold a substantially longer strip of carbon coated paper or film, and one of the spool support shafts would be connected directly to the output shaft of a fixed motor-reducer unit. The modification could also provide for removing the carbon coated strip when it was entirely wound on one spool and then interchange the spools so that the strip may be used again. This procedure permits the carbon coated strip to be used several times.

Positioned directly below the print drum 70 are a plurality of hammer members 120 (FIG. 8) which are aligned in a laterally extending row with one hammer member for each circumferentially extending row of characters on the print drum 70. The hammer members 120 are supported for independent vertical sliding movement within a support frame 122 having slots for receiving the hammer members. Each of the hammer members 120 includes a pivotally supported head portion 123 which is positioned adjacent the slot within the bottom guide plate 32. In the embodiment shown, there are twelve hammer members 120. However, either a greater or lesser number of hammer members may be used if desired.

Figure 8:
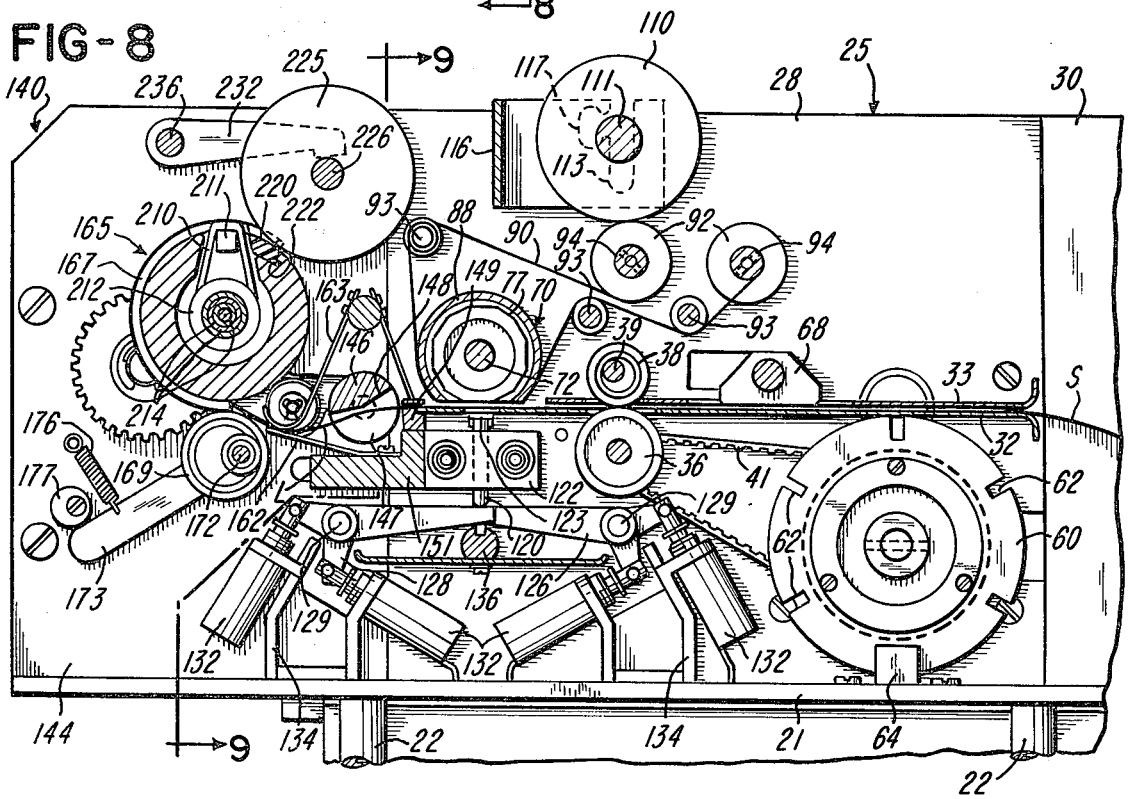
FIG. 8 is slightly enlarged section of the preprint and post-print units as taken generally on the line 8—8 of FIG. 6.
Figure 9:
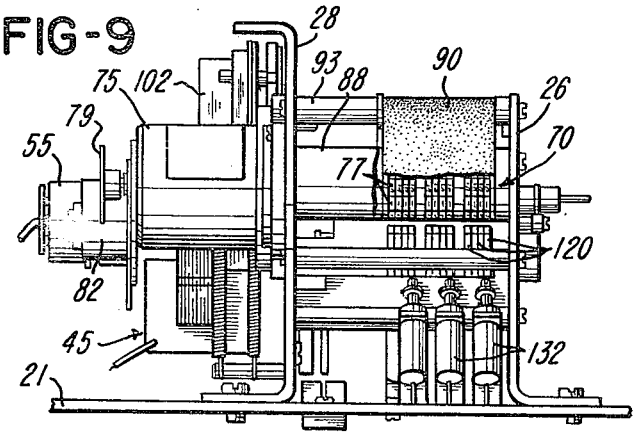
FIG. 9 is a view similar to FIG. 6 and of the preprint unit as taken generally on line 9—9 of FIG. 8.

The hammer members 120 are adapted to be individually actuated or elevated by a set of corresponding actuating levers 126 and 128 (FIG. 8) which are arranged in opposing interfitting relation and are supported by a pair of laterally extending parallel spaced shafts 129. Each of the levers 126 and 128 is pivotally connected to the armature of a corresponding solenoid 132, and a compact staggered arrangement of four rows of solenoids 132 are supported by two parallel spaced generally U-shaped brackets 134 (FIG. 8). The interfitting end portions of the levers 126 and 128 normally rest upon a cross bar 136, and each hammer member 120 is rapidly shifted upwardly in response to energizing of its corresponding solenoid 132. The actuation of the solenoids 132 is timed by the solid state control system so that it corresponds with the dwell of the stepping print drum 70 to effect printing of the corresponding information on each label L.

Figure 6:
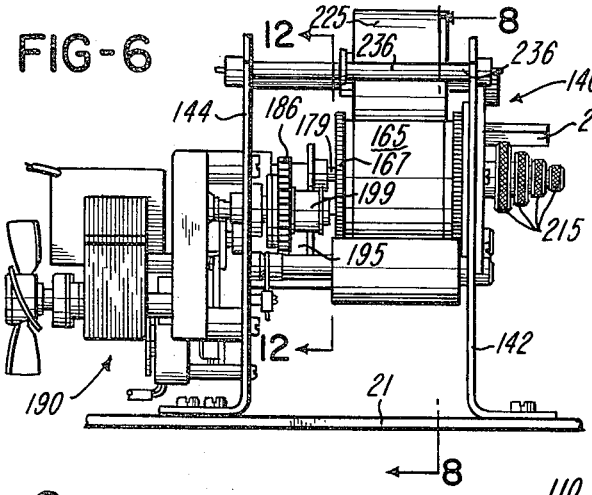
FIG. 6 is a view of the post print unit taken generally on the line 6—6 of FIG. 3.

A post-print unit 140 is mounted on the base plate 21 directly in front of the preprint unit 25 and includes an outer sidewall 142 (FIG. 6) and an inner sidewall 144 constructed in the same manner as the corresponding walls 26 and 28 of the preprint unit 25. The walls 142 and 144 support a rotary cut-off member 146 which is the form of a cylinder having a notch 147 (FIG. 8) extending slightly greater than 180° for receiving the paper strip S as it is ejected from the preprint unit 25. The notch 147 defines a cutting surface 148 which cooperates with a laterally extending stationary anvil 149 to shear the paper strip S. The anvil 149 is mounted on a cross-bar 151 which is rigidly secured to the walls 142 and 144 of the post-print unit 140.

The rotary cutting member 146 has opposite end journals which are supported by bearings mounted on the walls 142 and 144, and a lever 153 (FIG. 4) is mounted on the inner end portion or journal of the cutting member 146. The lever 153 is connected by a link 154 to a lever arm 156 mounted on the rotary output shaft of a rotary solenoid 158 secured to the inner wall 144 of the post-print unit 140. When the solenoid 158 is energized, the cutting member 146 rotates clockwise (FIG. 8) so that the outer edge of the surface 148 cooperates with the anvil 149 to shear the paper strip S along a line which corresponds to the length of each label L. As the paper strip S is fed into the rotary cutting member 146, the leading end portion is guided by a guide plate 163 (FIG. 8) mounted on the cross bar 151, and a spring finger 163 holds the leading end portion of the strip into engagement with the guideplate 162. The spring finger 163 is supported by a cross rod 164 which forms a rigid connection between the walls 142 and 144 of the post-print unit 140.

As shown in FIG. 8, the leading edge of the label strip is directed to engagement with a rotary print cylinder 165 which has a set of outwardly projecting peripherally extending end rims or ribs 167. Each of the ribs 167 has a knurled outer surface which engages the resilient outer surface of a back-up roll 169 (FIG. 8) positioned directly under the print cylinder 165. The back-up roll 169 is secured to an eccentrically located shaft 172 which is rotatably supported by bearings mounted on the walls 142 and 144. A lever 173 is secured to the shaft 172 and is held by tension spring 176 against a stop member 177 secured to the wall 144 by an eccentrically located screw. The rotary adjustment of the stop member 177 provides for precisely controlling the pressure of the back up roll 169 against the ribs 167 of the print cylinder 165.

Figure 3:
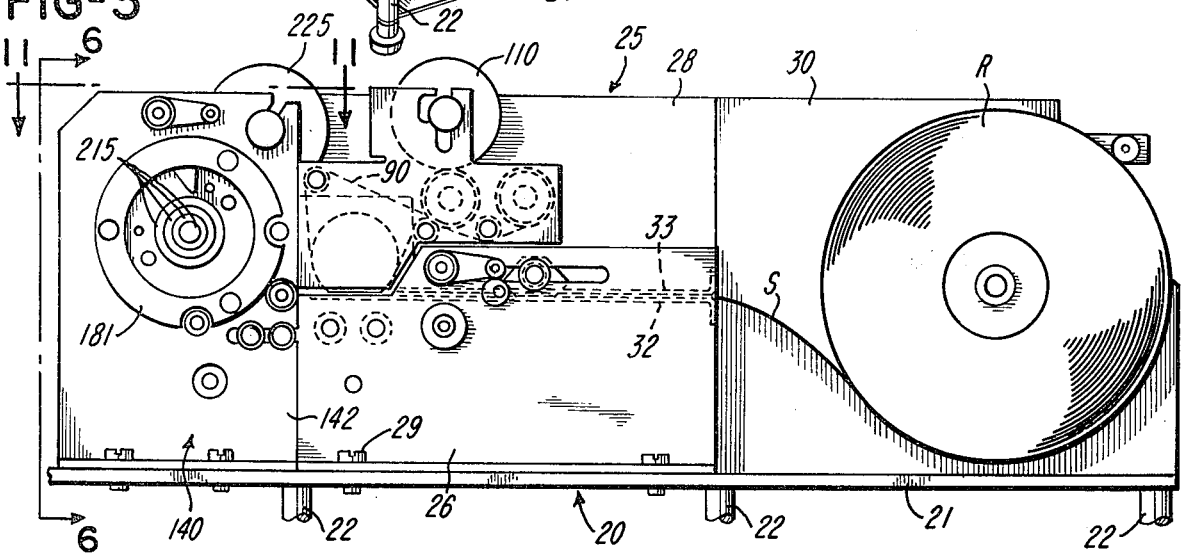
FIG. 3 is a side-elevational view of the printing unit shown in FIG. 1.

The inner end of the print cylinder 165 is mounted on a shaft 179 (FIGS. 6 & 12) which is rotatably supported by a bearing 182 (FIG. 11) mounted on the inner wall 144. The outer end portion of the print cylinder 165 is rotatably supported by an annular bearing 181 (FIGS. 1 and 3) which is secured to the front wall 142. A gear 183 (FIG. 11) is mounted on the shaft 179 adjacent the bearing 182 and meshes with a larger gear 186 which is mounted for rotation on the output shaft 188 of electric motor and gear reducer unit 190. The unit 190 is secured to the inner wall 144 by a set of screws 192 (FIG. 11) which extend through tubular spacers 193.

The shaft 188 extends through a bearing 194 secured to the inner wall 144 of the post-print unit 140, and a clutch 195 connects the shaft 188 to the gear 186. The clutch 195 includes a metal disc 196 which is secured to the shaft 188 for rotation therewith, and a rubber friction washer or clutch pad 197 is positioned between the disc 196 and the gear 186. A compression spring 199 (FIG. 11) urges the gear 186 against the clutch pad 197 so that the gear 186 is normally driven by the shaft 188 through the friction clutch 195 formed by the disc 196, friction pad 197 and compression spring 199.

A disc-like stop member 203 (FIGS. 11 and 12) is secured to the shaft 179 adjacent the gear 183 and has a notched surface 204 which is normally engaged by a latch lever 206 pivotally supported by a pin-like stud 207 secured to the inner wall 144. The opposite end of the lever 206 normally engages a flat surface 209 (FIGS. 11 and 12) formed on the rotary cutting member 146. The stop member 203 and the latch lever 206 cooperate to provide precisely 360° rotation or one revolution of the print cylinder 165 during each cycle of operation of the post-printing unit 140. That is, when the rotary cutting member 146 is oscillated in response to actuation of the rotary solenoid 158, the latch lever 206 rotates counterclockwise (FIG. 12) to release the stop member 203 and permit one revolution to the print cylinder 165 by the motor-reducer unit 190. The friction slip-clutch 195 permits continued coasting or rotation of the shaft 188 after the print cylinder 165 is stopped in response to engagement of the lever 206 with the surface 204 on the stop member 203.

Figure 11:
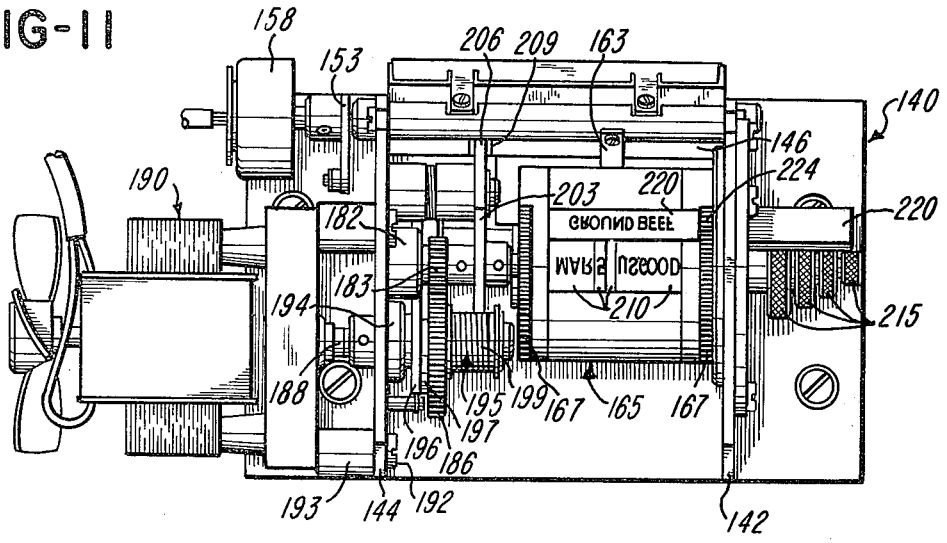
FIG. 11 is a view of the post-print unit of the printing apparatus as taken on the line 11—11 of FIG. 3, and with an inking roll removed.
Figure 12:
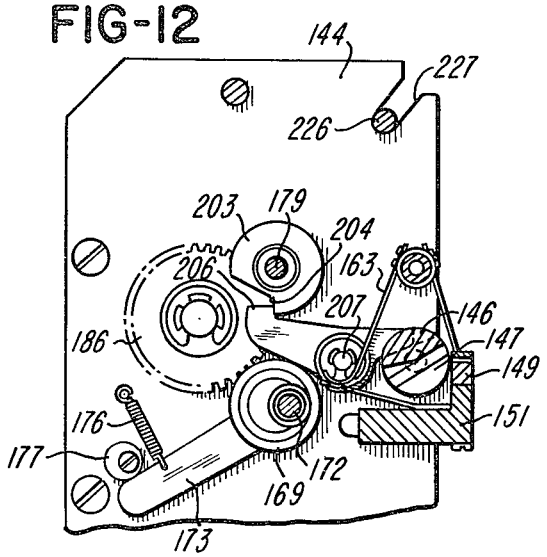
FIG. 12 is a slightly enlarged fragmentary section taken generally on the line 12—12 of FIG. 6.

Referring to FIG. 8, the hollow print cylinder 165 encloses a set of axially disposed endless flexible print bands 210 which extend around a cantilevered stud 211 formed as an integral part of the cylinder 165. The print bands 210 are constructed similar to those bands used in a conventional hand operated date stamp, and each band 210 is provided with different selectable alpha/numeric characters. Each of the bands 110 extends around a corresponding drum 212, and the drums 212 are mounted on corresponding concentric tubular shafts 214. The shafts 214 project through the annular bearing 181 mounted on the outer wall 142, and a set of corresponding knobs 215 are mounted on the concentric shafts 214 to provide for conveniently adjusting the bands 210 for selecting different information to be printed by the print cylinder 165. As shown in FIG. 11, as an example, the date of "March 5" and the words "U.S. GOOD" are positioned at the printing surface of the print cylinder 165 by adjustment of the knobs 215.

Figure 2:
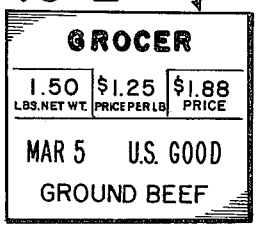
FIG. 2 is a face view of a typical label printed with the apparatus.
Figure 7:
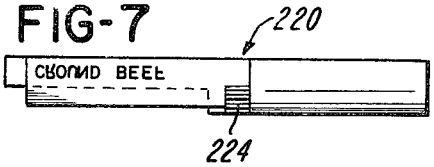
FIG. 7 is a plan view of a removable printing key which is used in the printing unit shown in FIGS. 1–4.

The print cylinder 165 also carries an interchangeable data or print key 220 (FIGS. 7, 8 and 11) which is preferably molded of a plastics material and is pressed axially into a dovetail-like slot 222 formed within the print cylinder 165 adjacent the bands 210. A set of interchangeable data keys 220 provide for quickly adding different information to the post-print cylinder 165, for example, for printing a particular commodity such as "GROUND BEEF" on each label, as shown in FIG. 2. Preferably, each of the data keys 220 includes a integrally molded arcuate projection 224 (FIG. 7) which has a knurled outer surface forming an extension of the knurled outer surface on the adjacent rib 167 of the print cylinder 165. The print cylinder 165 usually also carry a rigid or flexible printing plate (not shown) which is attached to the outer cylindrical surface of the print cylinder by suitable means. The raised printing characters on each data key 220 are preferably molded as an integral part of the data key but may be formed by inserting type into a longitudinally extending slot formed within the data key.

Figure 14:
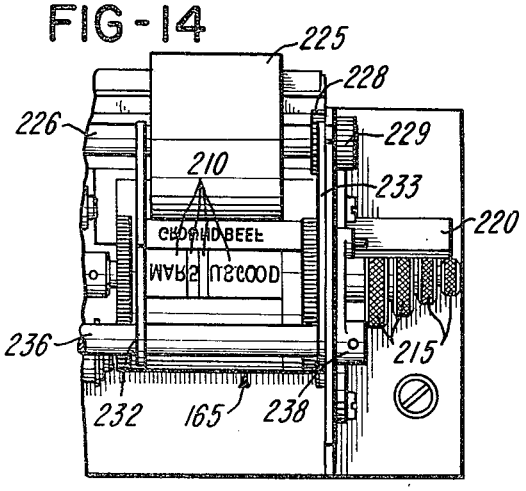
FIG. 14 is a fragmentary view similar to FIG. 11 and showing the inking roll for the post-print unit.

The printing surfaces of the characters on the data key 20, the print bands 210 and the printing plate on the print cylinder 165 are all inked during each clockwise revolution (FIG. 8) of the print cylinder 165 by porous type inking roll 225 (FIG. 8). The inking roll 225 is positioned above and to the right of the print cylinder 165 and is supported by a shaft 226 which has eccentric journals projecting into correspondingly inclined slots 227 (FIG. 12) formed within the side walls 142 and 144 of the post-print unit 140. The outer journal carries a gear 228 (FIG. 14) and a hand knob 229.

A set of arms 232 and 233 (FIG. 14) are rigidly secured to a rotatable shaft 236 rotatably supported by the sidewalls 142 and 144, and a lever arm 238 (FIGS. 1 and 14) is secured to the outer projecting end portion of the shaft 236. A tension spring (not shown) connects with the lever arm 239 for urging the arms 232 and 233 downwardly against the shaft 226 to hold the shaft within the bottoms of the slots 228. The outer end portion of the arm 233 is pointed for engaging the gear 228 so that by rotating the knob 229, the inking roll 225 may be precisely positioned relative to the outer printing surfaces of the characters on the print cylinder 165. The shaft 226 of the inking roll 225 is held in the selected position as a result of the engagement between the outer pointed tip of the arm 233 and the teeth on the gear 228.

In operation of the printing apparatus illustrated in the drawings, the appropriate data key 220 is inserted axially into the print cylinder 165, and the flexible bands 210 are set according to the desired information to be printed on each label of a series of labels corresponding to type of commodity. The electrical signals received from the computing scale system and corresponding to the information which changes for each label, are fed into the control system of the printing apparatus, and the appropriate solenoids 132 are energized in timed relation with the high speed indexing of the print drum 70. After the appropriate information is printed, for example, the net weight, price per pound and computed price, as illustrated in FIG. 2, the paper label strip S is advanced by a predetermined distance, corresponding to the length of the label, in response to energizing of the motor-reducer unit 45, as described above.

After the preprinted leading end portion of the strip S is fed out through the notch 147 within the cutting member 146 and out onto the guideplate 162, the cutting member 146 is rotated by actuation of the solenoid 158. The rotation of the cutting member 146 also releases the latch lever 206 from the stop member 203 and permits the print cylinder 165 to rotate one revolution in response to energizing of the motor-reducer unit 190. The rotation of the print cylinder 165 is not only effective to print the label after it is sheared or severed from the strip S, but is also effective to feed the label L below the print cylinder 165 and deposit the label onto an inclined chute or device for applying the label to the product or article after it is removed from the platform of the scale system. The above described printing cycle is repeated for each successive label.

From the drawings and the above description, it is apparent that a printing apparatus constructed in accordance with the present invention, provides desirable features and advantages. For example, one important advantage is provided by the modular preprint unit 25 and post-print unit 140. These separate units may be independently removed from the base frame 20 to provide for more efficient servicing and to minimize down time of the computing scale system during servicing of the label printing apparatus. It is also apparent that the preprint unit 25 may be used without the post-print unit 140, for example, if it was desired to print a series of pressure sensitive labels or other labels which did not require the common data or information. When pressure sensitive labels are used, the carrier strip is peeled from the labels adjacent the end of either the preprint unit 25 of the post-print unit 140 by directing the carrier strip around a relatively sharp edge in a conventional manner.

Another important feature of the printing apparatus of the invention is the high speed printing operation which is provided by precisely coordinating the separate electrical controls of the major components. For example, the high speed indexing of the print drum 70 by the stepping motor 75 and the synchronized actuation of the hammer members 120 by energizing the corresponding solenoids 132, provides for high speed printing of the changing data or information. In addition, the construction of the print cylinder 165 provides for conveniently changing the common information by adjustment of the knobs 215 and/or by interchanging data keys 220.

it is also apparent that the location of the inking roll 225 eliminates the requirement for purging the system so that it is not necessary to print a scrap label after any change of the data printed by the print cylinder 165. That is, as soon as the print cylinder 165 is released for rotation through one revolution, the data key 220 and the exposed characters on the print bands 210 and on the printing plate, are immediately inked by the roll 225 before the printing surface engages the label severed from the paper strip S. As mentioned above, the independent drive systems for advancing or feeding the label strip S, for feeding the inking ribbon 90 and for rotating the print cylinder 165, provide further desirable features of the invention.

While the forms of apparatus herein described constitute preferred embodiments of the invention, it is to be understood that the invention is not limited to these precise forms of apparatus, and that changes may be made therein without departing from the scope and spirit of the invention as defined in the appended claims.

The invention having thus been described, the following is claimed:

1. Apparatus for printing a series of labels and adapted for use with a computing scale system, said apparatus comprising a frame, means in substantially fixed relation to said frame for supporting a strip of labels in a supply roll, electrically operated first drive means for advancing the strip along a predetermined path in predetermined increments each corresponding to a printing cycle, a print drum including a plurality of circumferentially spaced printing positions, each of said printing positions including a plurality of the same printing character forming an axially extending row of common printing characters, means on said frame for rotatably supporting said drum for presenting each said row of common printing characters to a printing station adjacent the path of the strip, means for inking said rows of printing characters, electrically operated second drive means for producing high speed indexing of said print drum and including a stepping motor, said stepping motor being effective to step said print drum through a revolution for each said printing cycle to position sequentially each row of common printing characters at said printing station, means for holding said stepping motor and said print drum at a home position after each printing cycle, a plurality of hammer members arranged in a row adjacent said print drum on the opposite side of said path, each of said hammer members corresponding to one of said printing characters in each of said rows on said print drum, a corresponding plurality of electrically actuated solenoids connected for selectively moving said hammer members and cooperating with said stepping motor to print a line of different information across each label during each said printing cycle, a printing mechanism positioned to receive each label printed with different information by said print drum, and said printing mechanism includes means for printing interchangeable common information across each label after the label arrives at said printing station for receiving the different information whereby when the common information is changed, the next successive label printed with different information also receives the new common information to avoid the need for purging labels after the common information is changed.

2. Apparatus as defined in claim 1 wherein said means for inking said printing characters, comprise an inking ribbon extending from a first spool to a second spool, a motor driven and gear reducer unit having an output shaft, means supporting said unit for pivotal movement, planetary drive means including a center wheel driven by said output shaft, and at least one planetary wheel driven by said center wheel and positioned for alternately driving said first and second spools.

3. Apparatus as defined in claim 1 wherein each of said hammer members includes a substantially vertical elongated bar portion, means supporting each said bar portion for substantially vertical sliding movement, and a corresponding head portion pivotally connected to each of said bar portions.

4. Apparatus as defined in claim 1 wherein said means for printing common information across each label comprise a print cylinder supported for rotation on an axis substantially parallel to the axis of said print drum, and an electric drive motor separate from said first and second drive means and connected to rotate said print cyclinder.

5. Apparatus as defined in claim 4 including a releasable latch means for positively stopping said print cylinder at a predetermined position after each revolution of said print cylinder, a strip cutting member supported for rotation at a location between said print drum and said print cylinder adjacent the path of the strip, and electrically actuated means for rotating said cutting member and releasing said latch means.

6. Apparatus as defined in claim 4 including parallel spaced wall means releasably secured to said frame and supporting said print cylinder and said drive motor for said print cylinder for removal as a unit from said frame.

7. Apparatus as defined in claim 4 wherein said means for printing common information on each label include an elongated removable print key extending axially into said print cylinder adjacent the outer surface of said print cylinder, and said print key includes a portion projecting outwardly in an axial direction from said print cylinder to facilitate gripping and removing of said print key axially from said print cylinder.

8. Apparatus as defined in claim 7 wherein said print cylinder includes a circumferentially extending friction surface for engaging each label in response to rotation of said print cylinder, and said print key includes a circumferential extension of said friction surface.

9. Apparatus as defined in claim 4 including a plurality of axially disposed flexible printing bands extending into said print cylinder around the axis of said print cylinder, each of said printing bands having longitudinally spaced characters thereon, and means for selectively adjusting each of said printing bands to present each said character to the printing surface of said print cylinder.

10. Apparatus as defined in claim 9 wherein said means for selectively adjusting said printing bands comprise a plurality of manually rotatable concentric shafts projecting axially from said print cylinder, and each of said printing bands extends around at least one of said shafts.

11. Apparatus for printing a series of labels and adapted for use with a computing scale system, said apparatus comprising a frame, means in substantially fixed relation to said frame for supporting a strip of labels in a supply roll, an electric motor having a motor shaft, a gear reducer driven by said motor shaft and having an output shaft, drive means connected to said output shaft and responsive to starting and stopping of said electric motor for advancing the strip along a predetermined path in predetermined increments each corresponding to a printing cycle, means for sensing the advancement of the strip, means responsive to said sensing means for stopping said electric motor and releasably braking said motor shaft, a print drum including a plurality of circumferentially spaced printing positions, each of said printing positions including a plurality of the same printing character forming an axially extending row of common printing characters, means on said frame for rotatably supporting said drum for presenting each said row of common printing characters to a printing station adjacent the path of the strip, means for inking said rows of printing characters, electrically operated second drive means for producing high speed indexing of said print drum and including a stepping motor, said stepping motor being effective to step said print drum through a revolution for each said printing cycle to position each row of common printing characters at said printing station, means for holding said stepping motor and said print drum at a home position after each printing cycle, a plurality of hammer members arranged in a row adjacent said print drum on the opposite side of said path, each of said hammer members corresponding to one of said printing characters in each of said rows on said print drum, and a corresponding plurality of electrically actuated solenoids connected for selectively moving said hammer members and cooperating with said stepping motor to print a line of different information across each label during each said printing cycle.

12. Apparatus as defined in claim 11 wherein said means for releasably braking said motor shaft comprises a brake drum connected to rotate with said motor shaft, a rotary solenoid having a rotary shaft aligned axially with said motor shaft, a set of brake shoes supported for movement within said brake drum, and means for moving said brake shoes into engagement with said brake drum in response to rotation of said shaft of said rotary solenoid.

13. Apparatus as defined in claim 11 wherein said means for sensing the advancement of the strip comprise a control disc connected to rotate with said output shaft of said gear reducer, said control disc having control zones spaced circumferentially corresponding to the length of the labels, and means for detecting said control zones for controlling the operation of said electric motor and said means for braking said motor shaft.

* * * * *